United States Patent [19]

Ammann

[11] Patent Number: 4,478,522

[45] Date of Patent: Oct. 23, 1984

[54] DEVICE FOR ROTATIONALLY DRIVING A MEMBER INTERMITTENTLY

[75] Inventor: Ernst Ammann, Moutier, Switzerland

[73] Assignee: ETA S.A., Fabriques d'Ebauches, Granges, Switzerland

[21] Appl. No.: 421,388

[22] Filed: Sep. 22, 1982

[30] Foreign Application Priority Data

Nov. 5, 1981 [CH] Switzerland ..... 7069/81

[51] Int. Cl.[3] ..... G04B 19/20

[52] U.S. Cl. ..... 368/37; 368/35

[58] Field of Search ..... 368/34, 35, 37

[56] References Cited

U.S. PATENT DOCUMENTS

| | | | |
|---|---|---|---|
| 3,738,097 | 6/1973 | Vuilleumier | 368/37 |
| 3,841,084 | 10/1974 | Eumier | 368/37 |
| 4,060,977 | 12/1977 | Rochat | 368/35 |
| 4,081,950 | 4/1978 | Chappatte | 368/37 |
| 4,240,249 | 12/1980 | Malkin et al. | 368/37 |
| 4,261,047 | 4/1981 | Nakao | 368/37 |

FOREIGN PATENT DOCUMENTS 2026213 1/1980 United Kingdom .

*Primary Examiner*—Bernard Roskoski

*Attorney, Agent, or Firm*—Stensley Horn Jubas & Lubitz

[57] ABSTRACT

The driving mechanism of the day of the month disk (18) comprises a driving wheel (14) and a transmission wheel (16) The driving wheel (14) comprises a toothed sector (26'a, 26'a) which can mesh with the pinion (44) of the transmission wheel (16) and peripheral wall surface (26'a) into which open the two ends (30' and 30'') of an arcuate groove (30). The transmission wheel (16) also comprises a member constituted by four arms (48a to 48d) carrying four studs (50a and 50d) which can enter the groove (30) and a pinion (52) which meshes with the disk (18). Outside the driving phases, two of the studs abut against the peripheral wall surface (26'b) in order to lock the disk (18). This mechanism provides for a low torque which enables the energy to be applied to the motor of the watch to be reduced.

3 Claims, 4 Drawing Figures

DEVICE FOR ROTATIONALLY DRIVING A MEMBER INTERMITTENTLY

BACKGROUND OF THE INVENTION

The present invention relates to a mechanism for rotationally driving a member intermittently, for example for driving a day of the month indicator for watches having an analog display and, more especially, for electronic watches.

It is well known that in analog watches, the indication of the day of the month is effected conventionally by a disk or ring which bears the numbers 1 to 31, these numbers passing successively in front of a window formed in the dial of the watch. This indicator is rotationally driven by the gear train in such a manner that it advances one step every twenty-four hours. The locking in of each of the display positions of the day of the month indicator is usually effected by a resilient detent which engages successively between the different teeth of a set of teeth formed on the disk or the ring, as the indicator advances. During the daily actuation of the indicator, the motive force which needs to be applied to it is thus distinctly greater than the motive force that is required for only driving the hands of the watch, since it is necessary to furnish in addition the energy for withdrawing the resilient detent.

This excess of necessary energy, which is only very temporary since it is only produced once per 24 hours, is particularly prejudicial in the case of electronic watches. The motor has to be powerful enough to furnish the torque necessary for driving the indicator. In order to avoid having to supply constantly to the motor the amount of energy necessary to furnish this torque, it is possible to provide the motor with a control circuit which adapts the energy supplied to the motor to the load and hence in particular to the torque which needs to be applied to the day of the month indicator. However, such a circuit complicates the control circuit of the watch.

Accordingly, attempts have been made to reduce the torque which has to be applied to the day of the month indicator in order to make it advance one step.

Swiss Pat. No. 538.136 describes such a mechanism which enables the torque needed to drive the day of the month indicator to be reduced. In this mechanism, the detent for resiliently locking the day of the month indicator in its different positions is eliminated, whereby the torque that needs to be applied is reduced. But this mechanism has other disadvantages. Such a device comprises a driving disk, an intermediate plate provided with pins which cooperate with the disk and a day of the month indicating disk which is provided on its inner periphery with deep recesses. The intermediate plate is provided with two pins which can enter the recesses in the day of the month disk and can also cooperate with a projection and two recesses formed respectively on and in the periphery of the driving disk. The disk thus drives the day of the month disk one step during each of its rotations by way of the plate provided with its two pins. The locking of the disk is ensured by the presence of two supplementary studs mounted on the disk. Outside the driving phases, one of the studs and one of the pins engage the edge surface of the disk thus ensuring the immobilization of the disk while permitting a free rotation of the driving disk. This solution has serious disadvantages because of the cooperation between the pins and the slots formed in the day of the month disk and between these same pins and the projection formed on the driving disk. It is necessary to provide a substantial amount of play in order for the device to be able to function and the immobilization of the disk is therefore mediocre. In addition, these amounts of play give rise to supplementary shocks which consume energy and cause wear. Besides, according to the same document, in order to ensure an effective locking of the day of the month ring, there is provided a permanent magnet which effectively retains the ring and the plate that carries the studs in position.

BRIEF SUMMARY OF THE INVENTION

The main object of the present invention is to provide a mechanism for intermittently driving a member, and more particularly a day of the month disk, which has low torque but which does not have the disadvantages of the prior art described, that is to say which effectively ensures a good locking of the day of the month disk in each position and which avoids shocks and wear during the displacements of the disk.

The mechanism according to the invention comprises a driving wheel mounted for rotation about an axis and having on a portion of its periphery a toothed driving sector and a first immobilizing structure; and a transmission wheel. This transmission wheel has over the whole of its periphery a set of teeth for meshing, on the one hand, with the toothed driving sector of the driving wheel and, on the other hand, with teeth on the member to be driven; and a second immobilizing structure cooperating with the first immobilizing structure for enabling the transmission are in mesh with the teeth of the transmission wheel, while allowing the driving wheel to rotate freely irrespective of the position of the driving sector.

In the case in which the driven member is a day of the month indicator, it can thus be seen that the locking elements ensure the immobilization of the transmission assembly and hence the immobilization of the day of the month indicator, but in addition, during the periods when the day of the month indicator is being driven, the transmission of movement between the driving wheel and the day of the month indicator takes place exclusively through toothed gearing. On the one hand, this simplifies the production of the component parts and avoids shocks or wear during the driving of the day of the month indicator. As a result, there is a reduction in the torque required for displacing the day of the month ring. On the other hand, there is obtained a better positioning and a better locking of the day of the month indicator since the transmission wheel is permanently in mesh with the day of the month indicator.

Preferably, the toothed driving sector consists of two gear teeth which mesh with the teeth of the transmission wheel. Moreover, the second immobilizing means comprise n studs (preferably four) fixed for rotation with the transmission wheel. These studs are disposed on a circle centered on the axis of rotation of the intermediate wheel and they are angularly spaced apart by 360°/n. Moreover, the first immobilizing means comprise a circular rim which rotates with the driving wheel and is disposed at the same level as the studs. This flange is provided with two recesses which are so disposed and shaped that, during the driving phase of the day of the month indicator, one of the studs can pass through the rim whereas, outside the driving phase of the day of the month indicator, two studs are in abutment against the rim in order to ensure the locking of the transmission wheel and consequently the locking of the day of the month indicator whose teeth are in mesh with the teeth of the transmission wheel.

It should be observed that the studs play no part in transmitting drive during the rotation of the transmission wheel. Consequently, the dimensions are not critical and it is possible to give them a size such that there is no problem in introducing the studs into the recesses.

BRIEF DESCRIPTION OF THE DRAWINGS

The invention will be better understood on reading the following description of an embodiment of the invention, given by way of example with reference to the accompanying drawings in which.

DETAILED DESCRIPTION OF THE PREFERRED EMBODIMENT

Figure 1:
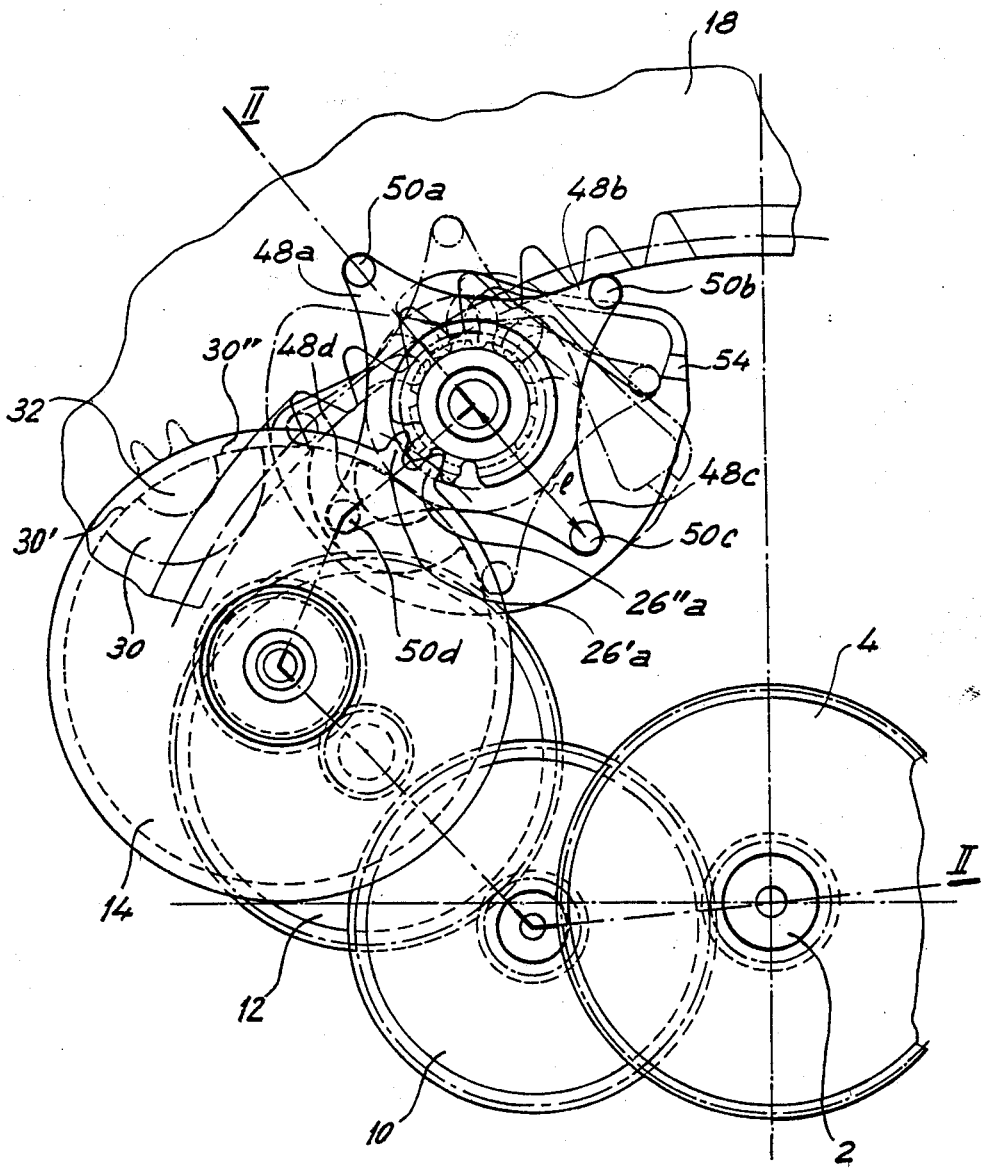
FIG. 1 is a top plan view of the whole of the driving mechanism.
Figure 2:
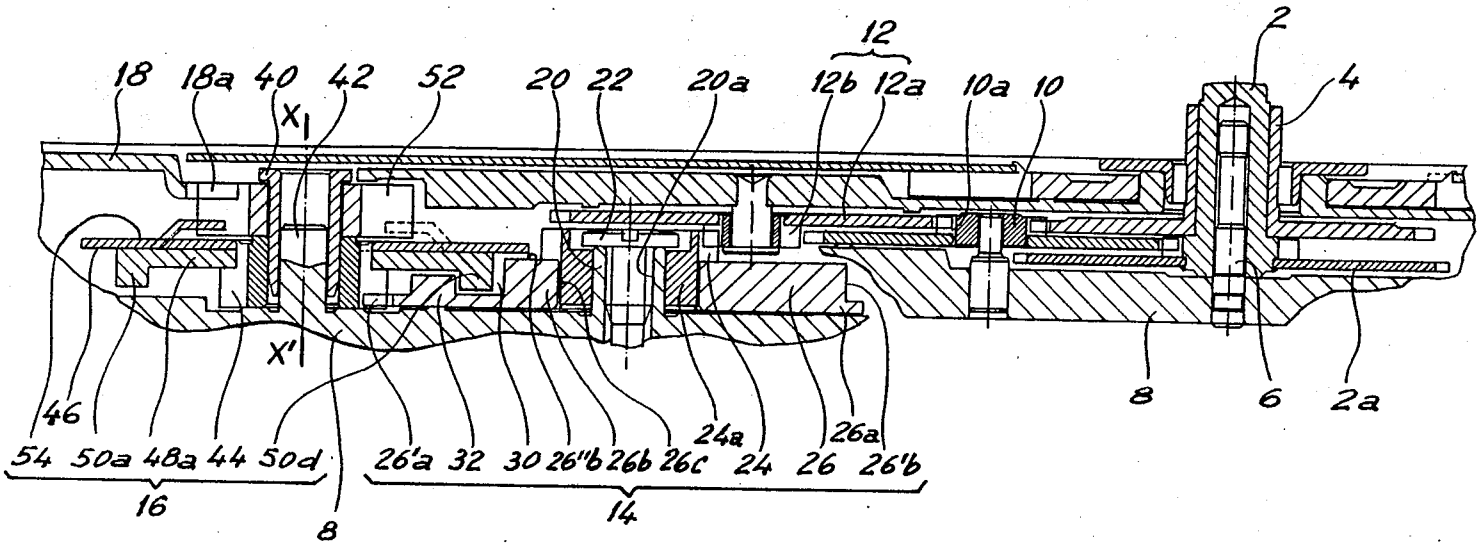
FIG. 2 is a view in section and in elevation of the mechanism taken on the line II—II of FIG. 1.

The description which follows is concerned with the case where the mechanism serves for driving a day of the month ring in an electronic watch hereinafter called "date ring". It is, however, obvious that this mechanism could be used for the intermittent driving of other rotatable moving parts in so far as these parts have a set of teeth and it is necessary to ensure a locking of the driven part between the driving phases in so far as this intermittent driving should be effected with a torque which is as low as possible.

Referring now to the figures, the watch comprises in conventional manner a center wheel 2 and a cannon wheel 4 which are mounted on an arbor 6 fixed to the body 8 of the watch. A minute wheel 10 is driven by the center wheel 2 and drives the cannon wheel 4. The center wheel 2 is driven in conventional manner by a train of gears driven by the motor and which acts on a wheel 2*a* which is rigid with the center wheel 2. This train of gears and the motor have not been shown since they are of conventional type and do not concern the invention. The pinion 10*a* of the minute wheel 10 meshes with a wheel 12*a* of a date intermediate gear 12. A pinion 12*b* forming part of the date intermediate gear 12 meshes with a driving wheel 14, the construction of which will be described later. This driving wheel 14 cooperates with a transmission assembly 16 which will likewise be described later. Finally, the transmission assembly 16 cooperates with a date indicator 18, namely the date ring in the embodiment shown.

The wheel 14 is rotatably mounted on a hollow boss 20 forming an integral part of the body 8. The wheel 14 is held on boss 20 by the head of a screw 22 engaged in a screw-threaded bore 20*a* in the boss 20. The wheel 14 comprises first of all a toothed pinion 24, the hub 24*a* of which extends beyond the toothed part. The wheel 14 comprises a second part constituted by a massive portion 26 with a central bore 26*c* in which is engaged the hub 24*a* of the pinion 24. There is thus obtained a rigid connection between these two parts which rotate together about the axis defined by the boss 20. The portion 26 comprises a disk 26*a* close to the body 8, the disk 26*a* comprising a toothed sector constituted for example by two teeth 26'*a* and 26''*a*. The member portion 26 further comprises a cylindrical portion 26*b* with a diameter less than that of the disk 26*a*. The portion 26*b* has therefore a peripheral wall surface or rim 26'*b* and a flat end wall surface 26''*b* parallel to the disk 26*a*.

The cylindrical portion 26*b* contains a groove 30 having substantially the form of part of a circular annulus which opens on the one hand into the flat surface 26''*b* and on the other hand into the rim 26''*b* via two grooved ends 30' and 30''. The remaining part 32 of the cylindrical portion 26*b* delimited by the groove 30 has a thickness less than the thickness of the remainder of this portion. The axis of symmetry of the groove 30 coincides with the axis of symmetry of the teeth 26'*a* and 26''*a*.

The transmission assembly 16 is mounted for rotation about an axis defined by a boss 40 engaged over a projection 42 which forms an integral part of the body 8. The assembly 16 comprises first of all a pinion 44 mounted for rotation about the boss 40. The assembly 16 also comprises a plate 46 fixed for rotation with the pinion 44 and which has four radially projecting arms 48*a*, 48*b*, 48*c* and 48*d* on the ends of which are fixed projections or studs 50*a*, 50*b*, 50*c* and 50*d*. These studs are disposed on one and the same circle that is centered on the axis XX' of rotation of the assembly 16. The studs accordingly move around at the same time as the pinion 44. The length L of the arms is such that two consecutive studs can come into contact with the rim surface 26'*b* of the driving wheel. Their position is also such that they can penetrate freely into the groove 30 during the relative rotational movement of the wheel 14 and the transmission assembly 16. The groove 30 has a width and a depth sufficient to allow the free passage of the studs during the rotation of the two wheels. In addition, the ends 30' and 30'' of the groove 30 are so located in the rim surface 26'*b* that, as will be explained later, the studs can penetrate effectively into the groove 30 when the teeth 26'*a* and 26''*a* rotationally drive the transmission assembly 16. In addition, the pinion 44 is so disposed that it meshes with the teeth 26'*a* and 26''*a* of the driving wheel 14 in certain positions thereof. Finally, the transmission assembly 16 comprises a second toothed pinion 52 which can rotate freely on the boss 40. The connection between the pinion 44 and the pinion 52 is effected temporarily by a pawl 54. This pawl 54 is for example rigid with the plate 46. When the pawl 54 is fulfilling its function, the pinions 52 and 44 are therefore fixed for rotation. The day of the month ring 18 is provided on its interior periphery with teeth 18*a* which mesh with the teeth of the pinion 52 of the transmission assembly 16.

It can thus be seen that the driving wheel 14 comprises a driving sector constituted by the teeth 26*a*, 26''*a* and a first immobilizing structure constituted by the groove 30 and the rim surface 26'*b*, and the transmission assembly 16 comprises a moving transmission wheel constituted by the pinions 44 and 52 and a second immobilizing structure constituted by the studs 50 fixed on the ends of the arms 48. In addition, it is clear that the member 26*b* could be replaced by a mere flange defining the rim surface 26'*b* of the member 26*b*, this flange being pierced by two notches corresponding to the inlet and outlet openings 30' and 30'' of the groove formed in the member 26*b*.

It should be added that the gear ratios between the minute wheel, the date intermediate wheel 12 and the pinion 24 of the driving wheel 14 are such that the driving wheel 14 makes one revolution during each 24 hour period. Moreover, the number of teeth on the pinion 44 of the transmission assembly 16 is such that this pinion makes one revolution during each period of four days. Consequently, during each period of twenty-four hours the date ring 18 advances effectively by one step as it ought to do.

The manner in which the driving mechanism of the date ring operates follows from the preceding description. Outside the phases where the position of the date ring has to be changed, two of the studs are in contact with the rim surface 26'b of the driving wheel. Thus, the transmission assembly 16 is rotationally immobilized, but the driving wheel 14 can rotate freely under the driving action of the date intermediate wheel. So long as no substantial external torque is applied to the date ring 18, the pawl 54 fulfills its function and rigidly connects the plate 46 with the pinion 52. In this example, the resilient end part 54 of the pawl 54 cooperates with the pinion 52. The pinion 52 is thus also rotationally immobilized and the ring 18 is likewise immobilized due to the fact of the cooperation of the teeth of the pinion 52 with the teeth 18a of the date ring. It is important to note that the pinion 52 is permanently in mesh with the teeth 18a of the ring 18. It follows that, by means of the conventional techniques of toothed pinion cutting, it is possible to have a very reduced amount of play between the pinion 52 and the ring 18, which ensures an excellent positioning of the latter. Of course, if an external torque is applied to the crown wheel 18, for example by means of a device for correcting the indication of the day of the month, the member 46 remains locked, but the pinion 52 can be rotationally driven by the ring thanks to the resilient connection provided by the pawl 54.

Figure 3:
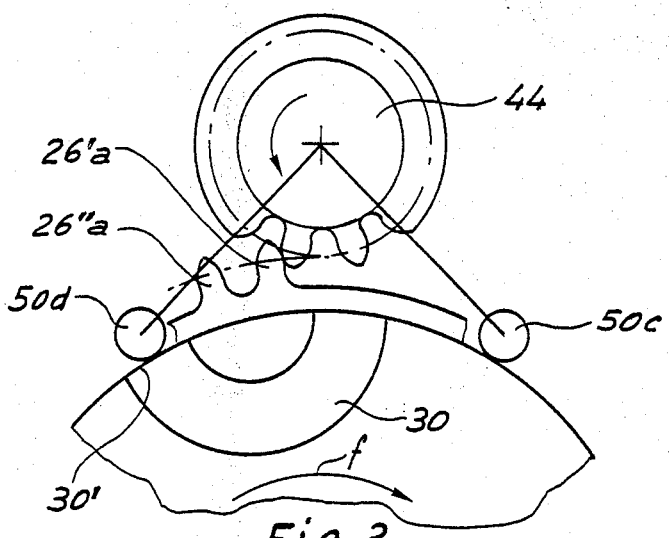
FIGS. 3 and 4 show a part of the driving mechanism at the beginning and at the end of a phase of the driving of the day of the month indicator.
Figure 4:
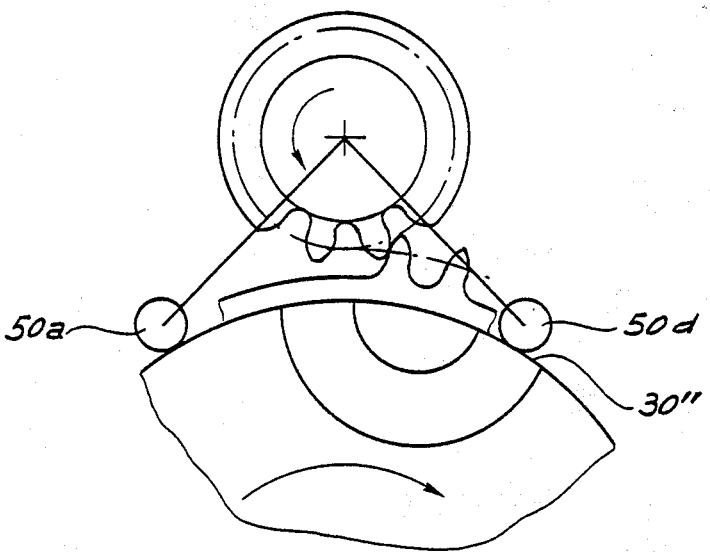

When a displacement of the date ring is to take place, one of the teeth 26'a of the wheel 14 comes into contact with the teeth of the pinion 44. In this situation, one of the studs, for example the one which bears the reference 50d and which was originally in contact with the rim surface of the member 26b, finds itself opposite the entrance 30' of the groove 30. FIG. 3 shows this situation. The rotation of the wheel 14 in the direction indicated by the arrow f brings about the rotation of the transmission wheel 16, that is to say of the pinion 44 which imparts rotation to the plate 46 and to the second pinion 52. Consequently the pinion 52 begins to bring about the rotation of the date ring 18 and the studs 50 also begin to move around. In particular, the stud 50d enters freely into the groove 30. When the teeth 26'a and 26''a cease being in mesh with the pinion 44, the stud 50d will have moved out of the groove 30 via the opening 30''. Moreover, the stud 50a will have come into contact with the rim surface of the member 26b. The transmission assembly 16 has effected a 90° rotation, this bringing the date ring 18 into the new position which it should occupy. There is of course no longer any driving of the wheel of the transmission assembly. Moreover, the latter is locked by the action of the studs 50a and 50d against the periphery of the member 26b or against the periphery of the portion 32 of the latter. This locking by the studs 50a and 50d is maintained until the driving wheel 14 has made one revolution so as to bring its toothed sector once again into mesh with the pinion 44.

It must merely be observed that, strictly, the locking does not occur when the studs are located opposite one of the groove ends 30' and 30''. This does not constitute a major disadvantage due to the fact that the width of this recess is substantially of the same order of size as the diameter of the studs. Consequently, the fraction of the periphery 26'b corresponding to this situation is extremely small and hence produces no harmful effect on the good functioning of the mechanism.

In the particular example previously described, the driving wheel 14 makes one revolution every twenty-four hours. It would of course be possible to provide a driving mechanism in which the driving wheel would for example make one revolution per $p \times 24$ hours. In this case, of course, the wheel would have to comprise p toothed sectors corresponding to the teeth 26'a, 26''a and a like number of grooves corresponding to the groove 30. However, the transmission assembly wheel would remain identical with its four studs.

It would also be possible to envisage a different number of studs for the transmission assembly, that is to say to define a different number of locking positions and hence a different number of days associated with one complete revolution of the transmission wheel.

Would it not be necessary to have the possibility of disconnection between the driving mechanism and the driven member, that is to say the date ring, this disconnection being effected in the example described by the pawl 54, it is possible to use only one single pinion instead of the pinions 44 and 52. The single pinion is permanently in mesh with the teeth of the member to be driven and temporarily with the toothed sector of the driving wheel.

It follows from the preceding description that the invention makes it possible to obtain effectively a mechanism driving a member such as a date ring with a low torque. There is no resilient detent acting directly on the date ring. Moreover, the transmission of movement between the different moving parts is effectively obtained by gear trains, which reduces play and shocks and enables the positioning of the day of the month indicator during the locking to be improved, thereby eliminating the need for supplementary positioning means.

Various other modifications of the present invention will be apparent to those skilled in the art, and it therefore is intended that the scope of the present invention is limited solely by the scope of the appended claims.

What is claimed is:

1. A device for rotationally driving a member intermittently, said member carrying a plurality of teeth, comprising:

a driving wheel mounted for rotation about an axis and having on its periphery two juxtaposed teeth and first immobilizing means;

a transmission assembly mounted for rotation about its axis and comprising a transmission wheel having over the whole of its periphery a set of teeth for meshing with the teeth of said driving wheel and with the teeth of said member, and second immobilizing means cooperating with said first immobilizing means for enabling said transmission wheel to rotate only when the teeth of said driving wheel are in mesh with the teeth of said transmission wheel and to enable said driving wheel to rotate freely at the same time; wherein said second immobilizing means comprises:

n stud members, where $n \geqq 2$, fixed for rotation with said transmission wheel and disposed on the same axis of rotation as said transmission wheel, said stud members being angularly spaced apart by (360°/n), and wherein said first immobilizing means comprises:

a circular flange fixed for rotation with said driving wheel, having the same axis as said driving wheel and being disposed at a level which is the same according to the direction of the axes of rotation of said stud member, said flange being provided with two recesses so that one of said stud members can pass through said flange during its rotation under the action of the meshing of said transmission wheel with the teeth of said driving wheel, whereas said stud members or two of said stud members abut against said flange outside said recesses when there is no meshing.

2. The device of claim 1, wherein said transmission wheel comprises:

a first pinion for rotation with said second immobilizing means for meshing with said driving wheel;

a second pinion for meshing with the teeth of said members; and retractable means for rotatably connecting said pinions.

3. The device of claim 1 or 2, wherein said member is a date ring of a watch provided with a gear train, said driving wheel further comprising:

a pinion for meshing with said gear train.

* * * * *